United States Patent [19]

Sumiyoshi et al.

[11] 4,187,816

[45] Feb. 12, 1980

[54] AIR-FUEL RATIO CONTROLLING SYSTEM FOR AN INTERNAL COMBUSTION ENGINE

[75] Inventors: Masaharu Sumiyoshi; Setsuro Sekiya; Katsuhiko Motosugi, all of Toyota; Junzo Uozumi, Nagoya; Tsuneo Ando, Chiryu; Yuzo Takeuchi; Mikio Minoura, both of Nagoya, all of Japan

[73] Assignees: Toyota Jidosha Kogyo Kabushiki Kaisha, Toyota; Aisan Industry Co., Ltd., Ohbu, both of Japan

[21] Appl. No.: 923,307

[22] Filed: Jul. 10, 1978

[30] Foreign Application Priority Data

Jul. 20, 1977 [JP] Japan ..... 52-87156

[51] Int. Cl.[2] ..... F02M 39/00; F02B 33/00

[52] U.S. Cl. ..... 123/139 AW; 123/139 BG; 123/119 EC; 123/32 EE

[58] Field of Search ..... 123/139 AW, 139 BG, 123/119 EC, 32 EE, 140 MC

[56] References Cited

U.S. PATENT DOCUMENTS

| | | | |
|---|---|---|---|
| 3,650,258 | 3/1972 | Jackson | 123/139 AW |
| 3,739,762 | 6/1973 | Jackson | 123/139 AW |
| 3,796,200 | 3/1974 | Knapp | 123/139 AW |
| 4,031,873 | 6/1977 | Banzhaf et al. | 123/119 A |
| 4,085,723 | 4/1978 | Tanaka et al. | 123/139 AW |

FOREIGN PATENT DOCUMENTS

| | | |
|---|---|---|
| 48-83220 | 11/1973 | Japan . |
| 48-83221 | 11/1973 | Japan . |
| 50-61520 | 5/1975 | Japan . |
| 50-61521 | 5/1975 | Japan . |

*Primary Examiner*—Charles J. Myhre
*Assistant Examiner*—M. Moy
*Attorney, Agent, or Firm*—Cushman, Darby & Cushman

[57] ABSTRACT

An air-fuel ratio controlling system for a fuel-injection type internal combustion engine has an air valve disposed in an air intake duct upstream of a throttle valve and a fuel-metering variable orifice disposed in a fuel circuit. The air valve and the fuel-metering variable orifice are operatively associated with each other and controlled normally to maintain the air-fuel ratio at a substantially constant value. Pressurized fuel is used as a working fluid to operate the air valve. $O_2$ sensor detects the oxygen content of exhaust gases to actuate a valve which varies the pressure of the working fluid to change the degree of opening of the air valve whereby the air-fuel ratio is adjusted in accordance with the output of the $O_2$ sensor.

3 Claims, 3 Drawing Figures

AIR-FUEL RATIO CONTROLLING SYSTEM FOR AN INTERNAL COMBUSTION ENGINE

BACKGROUND OF THE INVENTION

1. Field of the Invention

The present invention relates to an air-fuel ratio controlling system for a fuel-injection type internal combustion engine and, more particularly, to an air-fuel ratio controlling system of the type that includes an air valve disposed in an intake duct of the engine upstream of a throttle valve to cooperate with the throttle valve to define an air pressure chamber, a fuel-metering device disposed in a fuel circuit and cooperative with the air valve normally to maintain the air-fuel ratio at a substantially constant value, and an $O_2$ sensor provided to detect the oxygen content of engine exhaust gases and to emit an output signal which is utilized to adjust the air-fuel ratio.

2. Description of the Prior Art

There has been known an air-fuel ratio controlling system for an internal combustion engine of the type that has an intake duct with a throttle valve disposed therein. The system has an air valve disposed in the intake upstream of the throttle valve to cooperate therewith to define an air pressure chamber therebetween; an air valve controlling means responsive to variation in the air pressure in the air pressure chamber normally to maintain a substantially constant air pressure difference across the air valve; a fuel circuit having at its downstream end a fuel discharge port open to said intake duct; a fuel metering means defining a fuel-metering variable orifice disposed in the fuel circuit and means for maintaining a substantially constant fuel pressure difference across the fuel-metering variable orifice; the fuel-metering orifice defining means being operatively associated with the air valve so that the fuel-flowing area of the fuel-metering orifice is varied in proportion to the variation in the air-flowing opening area defined between the air valve and the intake duct; the air valve controlling means and the fuel metering means being cooperative to control the air-fuel ratio of an air-fuel mixture to be fed into the engine such that the air-fuel ratio is normally kept substantially constant; an $O_2$ for detecting the oxygen content of the engine exhaust gases; and means responsive to signal from the $O_2$ sensor to adjust the air-fuel ratio.

An air-fuel ratio controlling system of the type briefly discussed above is disclosed in Japanese Laid-Open Publication (Pre-Examination Publication) No. 48-83220 published on Nov. 6, 1973.

In the air-fuel controlling system disclosed in the Japanese publication referred to above, the $O_2$ sensor responsive means comprises an electro-magnetically operated valve disposed in a fuel return line of the system to control the fuel pressure in the fuel circuit downstream of the fuel-metering variable orifice thereby to vary the fuel pressure difference across the fuel-metering orifice so that the air-fuel ratio of the mixture to be fed into the engine is adjusted in accordance with the output of the $O_2$ sensor.

SUMMARY OF THE INVENTION

It is an object of the present invention to provide an improved air-fuel ratio controlling system in which pressurized liquid fuel is used as a working fluid for the system and in which the fuel pressure for controlling the degree of opening of an air valve is varied in accordance with variation in the output of an $O_2$ sensor to adjust the air-fuel ratio of the mixture to be fed into an engine.

According to the present invention, there is provided an air-fuel ratio controlling system of the type referred to above and in which the fuel circuit includes a high pressure fuel source kept at a substantially constant first pressure level higher than the atmospheric pressure and a low pressure fuel source kept at a substantially constant second pressure level higher than the atmospheric pressure but lower than the first pressure level; the air valve controlling means includes a cylinder, a piston slidably disposed in the cylinder to cooperate therewith to define a first fuel pressure chamber capable of being communicated with the high and low pressure fuel sources, a link means operatively connecting the piston to the air valve, a bore and a spool slidable in the bore and having a valve portion, the spool being movable in the bore in response to variation in the pressure in the air pressure chamber to cause the valve portion to control the communication between the first fuel pressure chamber and the high and low pressure fuel sources thereby to vary the pressure in the first fuel pressure chamber; and the $O_2$ sensor responsive means includes a second fuel pressure chamber defined by the cooperation of the bore and one end of the spool and communicated through a first restriction with the high pressure fuel source, a first fuel passage connecting the second fuel pressure chamber to the low pressure fuel source, and a valve means disposed in the first fuel passage and operative in response to variation in the output of the $O_2$ sensor to control the flow of the fuel from the second fuel pressure chamber through the first fuel passage to the low pressure fuel source thereby to vary the fuel pressure in the second fuel pressure chamber, the variation in the pressure in the second fuel pressure chamber moving the spool to vary the pressure in the first fuel pressure chamber so that the piston is moved to vary the degree of opening of the air valve and thus the air pressure difference across the air valve whereby the air-fuel ratio is adjusted.

The mechanical and hydraulic arrangement of the $O_2$ sensor responsive means of the system according to the present invention provides a stable and accurate air-fuel ratio controlling operation, is simple in structure and can be manufactured at a low cost and, in addition, provides a prolonged operative life.

The above objects, features and advantages of the present invention will be made apparent by the following description with reference to the accompanying drawings.

DESCRIPTION OF A PREFERRED EMBODIMENT

Figure 1:
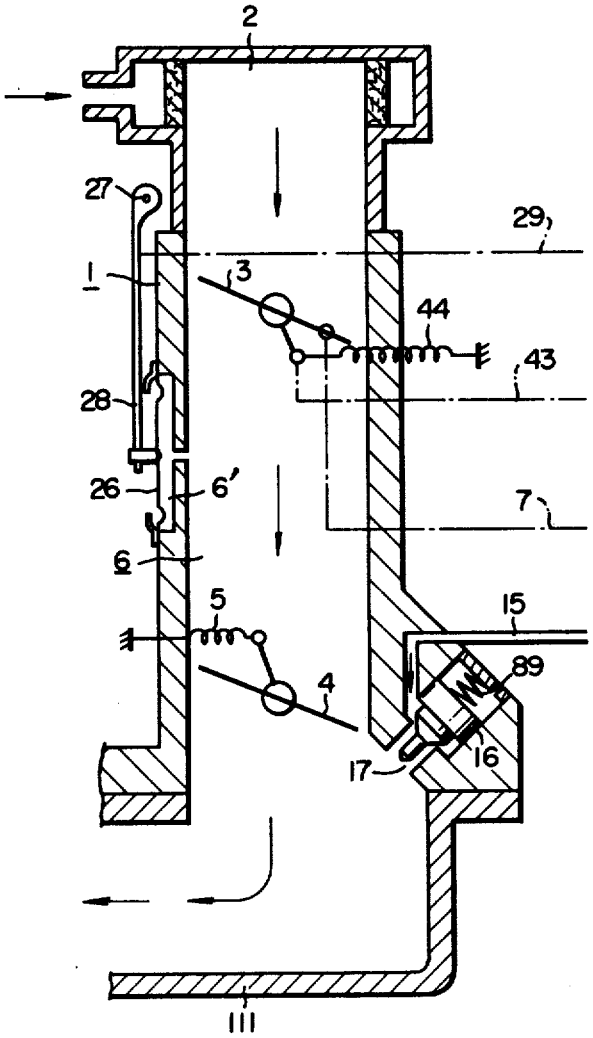
FIG. 1 is a partly sectional and partly diagrammatic illustration of a part of an intake system of an internal combustion engine and a part of an embodiment of an air-fuel ratio controlling system according to the present invention associated with the engine intake system.

A tubular hollow intake duct 1 of an internal combustion engine (not shown) defines therein an intake air passage and has an upstream end connected to an air cleaner 2. An air valve 3 and a throttle valve 4 are disposed in the intake air passage in series with each other. Air from the air cleaner 2 flows through the intake passage past the air valve 3 and the throttle valve 4 into an intake manifold 111 and thus into respective engine cylinders (not shown). The throttle valve 4 is always resiliently biased by a spring 5 in a direction to close the valve and is rotatable by an engine accelerator (not shown) to control the flow of the intake air into the engine in conventional manner. The air valve 3 is operatively connected to a feedback control means, to be described later, and is controlled such that the valve 3 is rotated toward its fully open position and fully closed position when the flow of the intake air is decreased and increased, respectively, to keep substantially constant the air pressure in an air pressure chamber 6 defined in the intake duct 1 between the air valve 3 and the throttle valve 4; i.e., to keep substantially constant the air pressure difference across the air valve 3.

The air valve 3 is operatively connected to a fuel metering rod 8 (shown in FIG. 2) by means of a linkage represented by a broken line 7. The fuel metering rod 8 is axially slidable in a cylinder 9 by the rotation of the air valve 3. The linkage 7 is constructed and arranged such that the axial displacement of the fuel metering rod 8 is in proportion to the increase or decrease of the area of the air-flow opening defined between the inner peripheral surface of the intake duct 1 and the outer peripheral edge of the air valve 3.

The fuel metering rod 8 is provided with an axial hole formed in the end of the rod disposed within the cylinder 9. A pair of diametrically opposite slits 10' are formed in the peripheral wall of the axial bore in the rod 8 and extend axially of the rod. A port is formed in the closed end of the cylinder 9 and connected through a passage 11 to a high pressure fuel source 20 to be described later. An annular groove 12 is formed in the inner peripheral surface of the cylinder 9 and connected to a passage 13. Fuel flows from the high pressure fuel source 20 through the passage 11 into the cylinder 9 from which the fuel flows through the slits 10' and the groove 12 and is delivered through the passage 13. The slits 10' and the groove 12 cooperate to define a fuel-metering orifice **12*a* the area of which is varied by the overlap between the slits 10' and the groove 12 to meter the flow of the fuel from the passage 11 to the passage 13**.

As described previously, the fuel metering rod 8 is operatively connected to the air valve 3 so that the axial displacement of the rod 8 is in proportion to the area of the opening defined by the air valve 3 and the intake duct 1. Thus, the fuel-flowing area of the variable fuel-metering orifice **12*a* is in proportion to the intake air-flow area of the opening defined between the air valve 3 and the intake duct 1. The fuel metered by the fuel-metering orifice 12*a* flows through the passage 13 and through a passage 15 to a fuel discharge valve 16 (shown in FIG. 1) which is spring-loaded by a compression spring 89. When the pressure of the fuel in the passages 13 and 15 exceeds a predetermined pressure which is determined by the spring 89, the fuel flows through the fuel discharge valve 16 and is discharged into the intake manifold 111 through a fuel discharge port 17 open to the intake manifold at a point downstream of the throttle valve 4**.

The fuel circuit includes a fuel tank 18 and a fuel pump 19 operative to pump up the fuel from the fuel tank 18 and pressurizes the fuel. A part of the pressurized fuel flows through the passage 11 and is metered by the fuel-metering orifice **12*a* and injected through the fuel discharge port 17 into the intake manifold 111. The high pressure fuel source 20 is formed of a passage connected to the fuel discharge port of the fuel pump 19. The fuel passage 20 is connected to a return passage 23 by a bypass passage 22 having a high pressure valve 21 disposed therein so that the pressure in the passage 20 is kept at a substantially constant pressure level which is higher than the atmospheric pressure. A low pressure valve 24 is disposed in the return passage 23 upstream of the point of connection of the return passage 23 to the bypass passage 22. Upstream of the low pressure valve 24 is provided a low pressure fuel source 25 kept at a substantially constant pressure level higher than the atmospheric pressure but lower than the pressure of the high pressure fuel source 20**.

As discussed previously, the pressure in the air pressure chamber 6 defined between the air valve 3 and the throttle valve 4 is kept substantially constant irrespective of the variation in the rate of the engine intake air flow. This is achieved by a feedback control means to be described hereunder. The feedback control means utilizes the fuel in the high and low pressure fuel sources 20 and 25 as a working fluid. With reference to FIG. 1, a recess 6' is formed in the outer peripheral surface of the intake duct 1 and communicated with the air pressure chamber 6. The outer opening of the recess is closed by a diaphragm 26 to which an arm 28 is connected at one end, the other end of the arm being pivoted at 27. The variation in the pressure in the air pressure chamber 6 displaces or deforms the diaphragm 26 so that the pressure variation pivotally moves the arm 28. Thus, the diaphragm 26 constitutes a sensor operative to detect the pressure in the air pressure chamber 6. The pivotal movement of the arm 28 is transmitted to a spool 31 of a pilot valve 30 (shown in FIG. 2) by means of a linkage represented by a broken line 29. The spool 31 is slidably received in a bore 32 which is provided with a pair of axially spaced ports 33 and 34 which are open in one side of the bore 32 and connected to the high and low pressure fuel sources 20 and 25, respectively. A third port 35 is open in the opposite side of the bore 32 and positioned between the ports 33 and 34 as viewed in the axial direction of the bore 32. A pair of annular grooves 37 and 38 are formed in the outer peripheral surface of the spool 31 and are separated apart by an annular land 36 of a width of an axial dimension substantially equal to the diameter of the port 35. The grooves 37 and 38 are communicated with the ports 33 and 34, respectively. A compression spring 39 is provided to exert an outward force to the spool 31. The port 35 is communicated with a chamber 42 which is defined between an inner end of a cylinder 41 and an inner end of an air valve driving piston 42 which is slidably received in the cylinder 41 and has an outer end operatively connected to the air valve 3 by means of a linkage represented by a broken line 43. A tension spring 44 is provided to bias the air valve 3 in a direction to rotate the valve toward its closed position.

If the degree of the opening of the throttle valve 4 is increased during an engine operation to increase the rate of engine air flow, the pressure in the air pressure chamber 6 in the intake duct 1 will be reduced unless the degree of the opening of the air valve 3 is changed. The reduction in the air pressure in the air pressure chamber 6 is detected by the pressure sensor (i.e., the diaphragm 26) which causes the arms 28 to displace the spool 31 rightwards as viewed in FIG. 2, so that the area of a variable orifice defined by the port 35 and the annular groove 37 is increased while the area of a variable orifice defined by the port 35 and the annular groove 38 is decreased. As a consequence, the fuel pressure in the chamber 42 inwardly of the piston 40 is increased to displace the piston 42 leftwards, as viewed in FIG. 2, so that the air valve 3 is rotated clockwise against the spring 44 to a further opened position. Thus, the resistance of the air valve 3 to the flow of air through the intake duct 1 is decreased to increase the pressure in the air pressure chamber 6. As such, the pressure in the chamber 6 is adjusted toward the predetermined pressure level. On the other hand, if the pressure in the air pressure chamber 6 is increased beyond the predetermined pressure level by the reduction in the degree of opening of the throttle valve 4, the spool 31 is displaced leftwards from its neutral position so that the flow of the fuel from the annular groove 37 into the port 35 is decreased while the flow of fuel from the port 35 into the annular groove 38 is increased. Thus, the pressure in the chamber 42 is lowered to allow the spring 44 to move the piston 40 rightwards as well as to rotate the air valve 3 toward its closed position. When the pressure in the air pressure chamber 6 is reduced to the predetermined level, the spool 31 is returned to its neutral position and the air valve 3 is held at a new, reduced degree of opening.

As described, the pressure sensor 26, the pilot valve 30 and the air valve driving piston 40 constitute a feedback control means which is operative to vary the degree of opening of the air valve 3 in response to decrease or increase in the air pressure in the air pressure chamber 6 such that the air pressure chamber 6 is kept substantially at the predetermined constant pressure level irrespective of changes of the rate of intake air flow. The feedback control means performs an integral control and thus provides a stable operation even in the event of an abrupt change of the rate of engine air flow. In addition, since the feedback control means utilizes the liquid fuel under a high pressure as a working fluid, the control means is responsive to changes of engine operating conditions more quickly than in the case where gaseous fluid is used as a working fluid. The pressure level predetermined for the air pressure chamber 6 is decided by the balance between the force exerted to the diaphragm 26 and the forces of the springs 39 and 44.

The passage 15 through which the fuel flows to the fuel discharge valve 16 has an upstream end connected to the passage 11 extending between the high pressure fuel source 20 and the cylinder 9. A fixed restriction 84 and a solenoid valve 85 which is opened during warming up of the engine are disposed in the passage 15. The passage 13 connected at the upstream end to the annular groove 12 is connected at the downstream end to the passage 15 at a point downstream of the solenoid valve 85. A fuel pressure chamber 48 is defined between the end of the spool 31 of the pilot valve 30 remote from the spring 39 and one end of the bore 32 and is connected to the passage 11 by a passage 50 in which a fixed restriction 49 is provided. The chamber 48 is also connected to the low pressure fuel source 25 by means of a passage **50*a*. In other words, the high and low pressure fuel sources 20 and 25 are connected by means of a fuel pressure line which consists of the passages 50 and 50*a* and in which is provided the fuel pressure chamber 48 which forms a variable fuel pressure chamber. The pilot valve 30 is arranged such that, when the air pressure chamber 6 is kept at a predetermined pressure level and when the fuel pressure chamber 48 is also kept at a constant pressure level, the force from the arm 28 of the pressure sensor, the force from the spring 39 and the pressure in the fuel pressure chamber 48 are balanced to locate the land 36 of the spool 31 of the pilot valve 30 at a position where the flow of fuel from the port 33 to the port 35 and the flow of fuel from the port 35 to the port 34** are balanced.

As described previously, the pressure sensor 26, the pilot valve 30 and the air valve driving piston 40 cooperate together to form the feedback control means which is responsive to variation in the pressure in the air pressure chamber 6 to rotate the air valve 3 in either direction so that the pressure in the air pressure chamber 6 is maintained substantially constant irrespective of variation in the rate of the engine intake air flow. As such, the air pressure downstream of the air valve 3, i.e., in the air pressure chamber 6, is maintained substantially constant regardless of the degree of opening of the air valve 3 provided that the balance between the forces and the pressure applied to the spool 31 of the pilot valve 30 remains unchanged. On the other hand, because the pressure in the intake duct 1 upstream of the air valve 3 is equal to the atmospheric pressure which can be regarded as being substantially constant, the flow of engine intake air through the intake duct 1 past the air valve 3 is in proportion to the air-flowing area of the opening defined between the air valve 3 and the inner peripheral surface of the intake duct 1.

The fuel pressure in the fuel circuit upstream of the fuel-metering variable orifice **12*a* which is defined by the cooperation of the slits 10' in the rod 8 and the annular groove 12 in the cylinder is equal to the fuel pressure in the high pressure fuel source 20, whereas the fuel pressure downstream of the fuel-metering orifice 12*a* is kept substantially constant by the fuel discharge valve 16 which is operative to discharge the fuel into the fuel discharge port 17 when the fuel pressure downstream of the fuel-metering orifice 12*a* exceeds a predetermined pressure level. Thus, a substantially constant fuel pressure difference is maintained across the fuel-metering orifice 12*a*. In addition, because the fuel metering rod 8 is operatively connected to the air valve 3 such that the fuel-flowing area of the fuel-metering variable orifice 12*a* is in proportion to the air-flowing area of the opening defined between the air valve 3 and the inner peripheral surface of the intake duct 1, the flow of fuel through the fuel-metering variable orifice 12*a* is in proportion to the flow of engine intake air through the intake duct 1 past the air valve 3. Accordingly, it will be understood that the above-described means for controlling the air valve 3** cooperates with the above-described fuel-metering means to control the air supply and fuel supply such that the supply of fuel to the engine is kept at a substantially constant rate relative to the flow of engine intake air irrespective of changes of the engine intake air flow rate. Stated in other words, the air-fuel ratio of air and fuel supplies to the engine is always kept substantially constant. This will be explained with reference to the following equations:

$$Ga \propto Aa\sqrt{Po - Pa} \quad (1)$$

wherein "Aa" is the air-flowing area of the opening defined between the air valve 3 and the intake duct 1, "Po" and "Pa" are the air pressures upstream and downstream of the air valve 3, respectively, and "Ga" is the intake air flow.

$$Gf \propto Af\sqrt{Ph - Pc} \quad (2)$$

wherein "Af" is the fuel-flowing area of the fuel-metering orifice 12*a*, "Ph" and "Pc" are the fuel pressures upstream and downstream of the orifice 12*a*, respectively, and "Gf" is the amount of fuel injected into the engine. The equations (1) and (2) are combined to obtain an air-fuel ratio Ga/Gf;

$$(Ga/Gf) \propto (Aa/Af)\cdot\sqrt{Po - Pa}/\sqrt{Ph - Pc} \quad (3)$$

The above-described air valve control means and the fuel circuit are arranged to keep the pressure differences "Po−Pa" and "Ph−Pc" respectively constant, while the air valve 3 and the fuel metering rod 8 are operatively connected to keep "Aa/Af" constant. Accordingly, the air-fuel ratio "Ga/Gf" is kept constant.

By the way, the present invention aims to detect the content of oxygen ($O_2$) in the engine exhaust gases by means of an $O_2$ sensor and to utilize the output of the $O_2$ sensor to control the air-fuel ratio of an air-fuel mixture supplied into an engine so that the air-fuel ratio is so adjusted as to be optimum to engine operating conditions. In order to achieve this object, the air pressure difference across the air valve 3 is varied in accordance with variation in the $O_2$ sensor output. An embodiment to achieve this object will be described in more detail with reference to FIG. 2.

A solenoid valve 60 and a fixed restriction 62 are provided in series in the passage 50*a* extending between the variable fuel pressure chamber 48 and the low pressure fuel source 25. A bypass passage 64, in which a fixed restriction 66 is provided, is provided in bypassing relationship to the restriction 62 and the solenoid valve 60. This valve 60 is of normally closed type and is opened when it is electrically energized. An $O_2$ sensor 68, which is conventional and well-known by those in the art, is mounted on an exhaust pipe 113 of the engine to detect the oxygen content of the engine exhaust gases. The $O_2$ sensor 68 is electrically connected via a valve actuator 70 to the solenoid valve 60. The valve actuator 70 is of a simplified circuit structure and consists of a comparator 72 and an amplifier 74. The comparator receives the $O_2$ sensor output at a minus (−) terminal and also receives a reference voltage $V_o$ at a plus (+) terminal. The amplifier 74 is connected to the output terminal of the comparator 72 to amplify the output thereof and also connected to the solenoid valve 60 at an output terminal of the amplifier. As is well known by those in the art, the output of the $O_2$ sensor is abruptly increased and decreased when the air-fuel ratio of an air-fuel mixture fed into the engine is increased and decreased beyond the stoichiometric air-fuel ratio. The valve actuator 70 is arranged such that the actuator emits an output voltage to the solenoid valve 60 to open the same when the output of the $O_2$ sensor 68 is lowered beyond a predetermined voltage level.

The pressure in the variable fuel pressure chamber 48 depends upon the two restrictions 49 and 66 when the solenoid valve 60 is closed and upon three restrictions 49, 66 and 62 when the solenoid valve 60 is opened. Thus, when the air-fuel ratio is increased beyond the predetermined value (i.e., the stoichiometric air-fuel ratio) with resultant decrease in the $O_2$ sensor output beyond the predetermined voltage level, the solenoid valve 60 is opened to lower the pressure in the variable fuel pressure chamber 48. On the contrary, when the air-fuel ratio is decreased beyond the predetermined value with resultant increase in the output of the $O_2$ sensor beyond the predetermined voltage level, the solenoid valve 60 is closed with resultant increase in the pressure in the fuel pressure chamber 48.

More specifically, it is assumed that the pressure "Pa" in the air pressure chamber 6 is at a predetermined value and the spool 31 of the pilot valve 30 is located at its neutral position. With this position, if the air-fuel mixture supplied into the engine is lean and the air-fuel ratio of the mixture is so large that the output of the $O_2$ sensor 68 is lower than the predetermined voltage level, the solenoid valve 60 is opened to reduce the pressure in the variable fuel pressure chamber 48 with a result that the spool 31 is moved rightwards, as viewed in FIG. 2, to increase the area of the overlap between the groove 37 and the port 35, i.e., the fuel-flowing area of the variable orifice which is defined by the groove 37 and the port 35 and through which the high pressure fuel source 20 is communicated with the port 35. Thus, the pressure in the chamber 42 at one end of the piston 40 is increased to displace the piston in a direction to rotate the air valve 3 toward its fully open position against the spring 44. Consequently, the pressure "Pa" in the air pressure chamber 6 is increased with resultant decrease in the air pressure difference (Po−Pa) across the air valve 3 and thus decrease in the air-fuel ratio (i.e., enrichment of the air-fuel mixture).

On the contrary, if the air-fuel mixture being fed into the engine is rich and the air-fuel ratio of the mixture is so small that the output of the $O_2$ sensor 68 is higher than the predetermined voltage value, the solenoid valve 60 is closed to increase the fuel pressure in the variable fuel pressure chamber 48 with a result that the spool 31 is moved leftwards to increase the area of overlap between the groove 38 and the port 35, i.e., the section of the variable orifice which is defined by the groove 38 and the port 35 and through which the low pressure fuel source 25 is communicated with the port 35. Thus, the pressure in the chamber 42 is lowered to allow the spring 44 to rotate the air valve 3 toward its closed position. Consequently, the pressure "Pa" in the air pressure chamber 6 is decreased with resultant increase in the air pressure difference (Po−Pa) across the air valve 3 and thus increase in the air-fuel ratio (mixture becomes leaner).

Assuming that the air pressure difference (Po−Pa) is increased by 10%, the following equation is obtained from the equation (3):

$$\frac{\text{Normal air-fuel ratio}}{\text{Adjusted air-fuel ratio}} = \frac{1}{\sqrt{1.1}}$$

Thus, the air-fuel ratio is increased by about 5% (mixture becomes leaner). On the contrary, if the air pressure difference (Po−Pa) is decreased by 10%, the air-fuel ratio is decreased by about 5% (mixture becomes richer).

Figure 2:
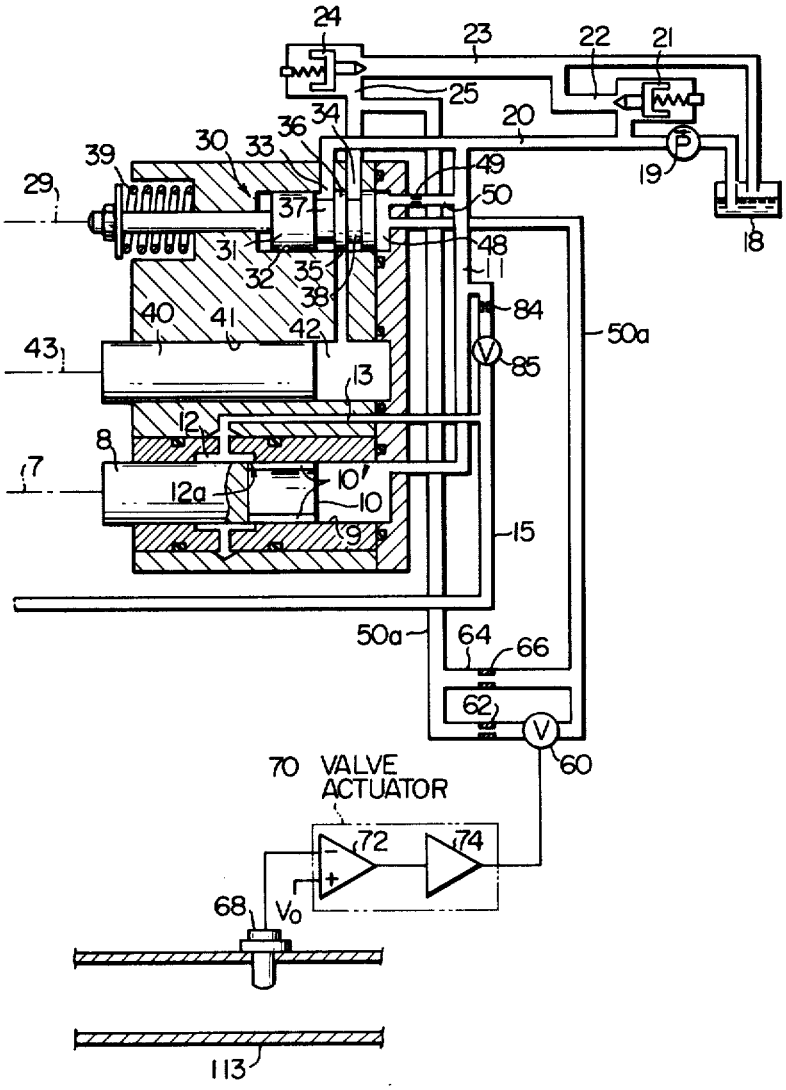
FIG. 2 is a partly sectional and partly diagrammatic illustration of the rest of the embodiment of the air-fuel ratio controlling system shown in FIG. 1.
Figure 3:
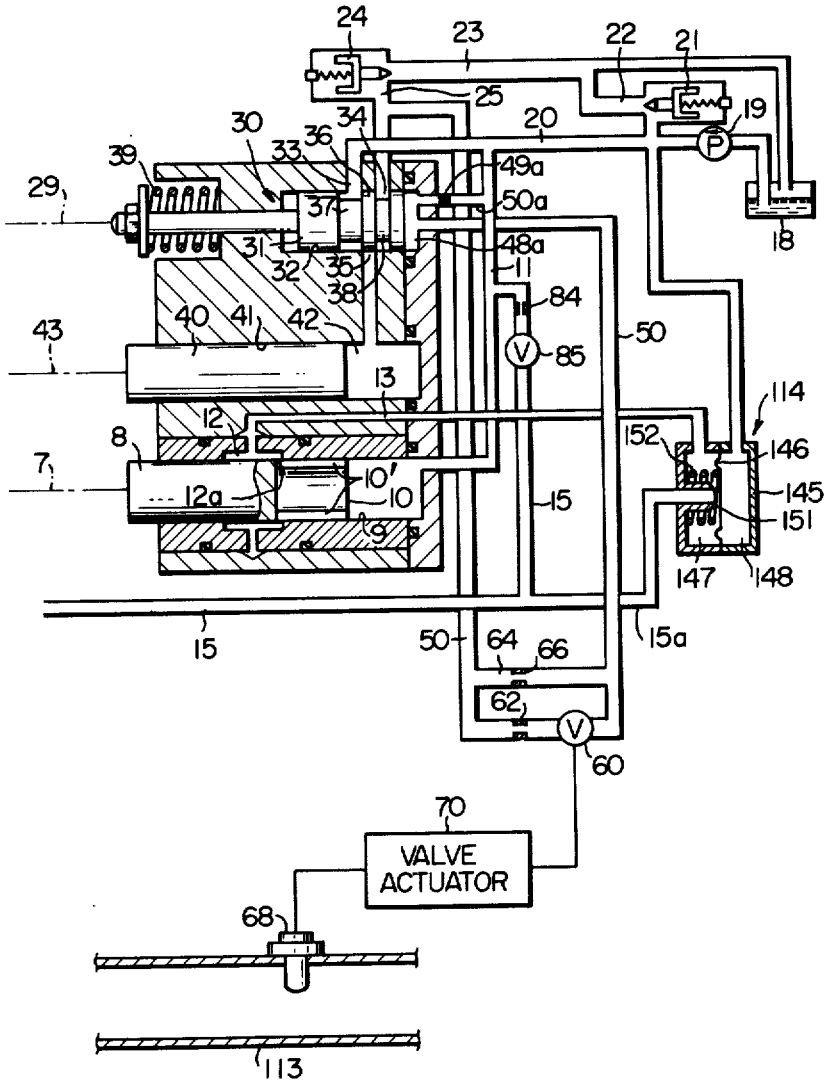
FIG. 3 is a view similar to FIG. 2 but illustrating a modification of the embodiment shown in FIGS. 1 and 2.

In the embodiment of the present invention shown in FIGS. 1 and 2, the pressure of the fuel in the fuel circuit downstream of the fuel-metering orifice 12*a* is kept at a substantially constant pressure level by the function of the fuel discharge valve 16. A modification in this point is shown in FIG. 3, wherein reference numeral 114 designates a constant pressure differential valve means comprising a substantially closed housing 145 and a diaphragm 146 which divides the interior of the housing into two chambers 147 and 148. The first chamber 147 is connected by the passage 13 to the annular groove 12, while the second chamber 148 is in direct communication with the high pressure fuel source 20. The first chamber 147 is also connected to the passage 15 by means of a passage 15*a*. The opening of the passage 15*a* to the chamber 147 is surrounded by a valve seat 151 disposed in close contacting relationship to the diaphragm 146. A compression coil spring 152 extends around the valve seat 151 between the housing 145 and the diaphragm 146 to resiliently bias the diaphragm away from the valve seat 151. The diaphragm 146, the valve seat 151 and the spring 152 cooperate to form a constant pressure differential valve. It will be noted that the second chamber 148 is kept at a substantially constant high pressure level equal to the pressure in the high pressure fuel source 20. If the fuel pressure difference across the fuel-metering orifice 12*a* becomes larger than a predetermined value due to decrease in the fuel pressure in the fuel circuit downstream of the fuel-metering orifice 12*a*, the diaphragm 146 is deformed leftwards as viewed in FIG. 3, so that the fuel-flowing passage between the valve seat 151 and the diaphragm 146 is narrowed or closed, with a resultant increase in the pressure in the first chamber 147 and thus decrease in the pressure difference across the fuel-metering orifice 12*a* to the predetermined value. On the contrary, if the fuel pressure difference across the fuel-metering orifice 12*a* is made smaller than the predetermined value by the increase in the fuel pressure in the fuel circuit downstream of the fuel-metering orifice 12*a*, the diaphragm 146 is deformed away from the valve seat 151 to lower the pressure in the first chamber 147 and thus increase the pressure difference across the fuel-metering orifice 12*a* to the predetermined value. As such, the pressure in the first chamber 147 is kept substantially constant thereby to keep the pressure difference across the fuel-metering orifice 12*a* substantially constant.

Except the point described above, the modification shown in FIG. 3 is similar in structure to the embodiment described with reference to FIGS. 1 and 2. Thus, the described modification is similarly operative in response to variation in the output of the $O_2$ sensor to change the air pressure "Pa" in the air pressure chamber 6 so that the air-fuel ratio of air-fuel mixture to be fed into the engine is controlled in accordance with the variation in the engine operating conditions and thus adjusted to be optimum to any engine operating condition.

What is claimed is:

1. An air-fuel ratio controlling system for an internal combustion engine having an intake duct with a throttle valve disposed therein, said system comprising:

an air valve disposed in said intake duct upstream of said throttle valve to cooperate therewith to define an air pressure chamber therebetween;

an air valve controlling means responsive to variation in the air pressure in said air pressure chamber normally to maintain a substantially constant air pressure difference across said air valve;

a fuel circuit having at its downstream end a fuel discharge port open to said intake duct;

a fuel metering means including means defining a fuel-metering variable orifice disposed in said fuel circuit and means for maintaining a substantially constant fuel pressure difference across said fuel-metering variable orifice;

said fuel-metering orifice defining means being operatively associated with said air valve so that the fuel-flowing area of said fuel-metering orifice is varied in proportion to the variation in the air-flowing opening area defined between said air valve and said intake duct;

said air valve controlling means and said fuel metering means being cooperative to control the air-fuel ratio of an air-fuel mixture to be fed into the engine such that the air-fuel ratio is normally kept substantially constant;

an $O_2$ sensor for detecting the oxygen content of the engine exhaust gases; and means responsive to signal from said $O_2$ sensor to adjust the air-fuel ratio; wherein:

said fuel circuit includes a high pressure fuel source kept at a substantially constant first pressure level higher than the atmospheric pressure and a low pressure fuel source kept at a substantially constant second pressure level higher than the atmospheric pressure but lower than said first pressure level;

said air valve controlling means includes a cylinder, a piston slidably disposed in said cylinder to cooperate therewith to define a first fuel pressure chamber capable of being communicated with said high and low pressure fuel sources, a link means operatively connecting said piston to said air valve, a bore and a spool slidable in said bore and having a valve portion, said spool being movable in said bore in response to variation in the pressure in said air pressure chamber to cause said valve portion to control the communication between said first fuel pressure chamber and said high and low pressure fuel sources thereby to vary the pressure in said first fuel pressure chamber; and said $O_2$ sensor responsive means includes a second fuel pressure chamber defined by the cooperation of said bore and one end of said spool and communicated through a first restriction with said high pressure fuel source, a first fuel passage connecting said second fuel pressure chamber to said low pressure fuel source, and a valve means disposed in said first fuel passage and operative in response to variation in the output of said $O_2$ sensor to control the flow of the fuel from said second fuel pressure chamber through said first fuel passage to said low pressure fuel source thereby to vary the fuel pressure in said second fuel pressure chamber, the variation in the pressure in said second fuel pressure chamber moving said spool to vary the pressure in said first fuel pressure chamber so that said piston is moved to vary the degree of opening of said air valve and thus vary the air pressure difference across said air valve whereby the air-fuel ratio is adjusted.

2. An air-fuel ratio controlling system according to claim 1, wherein said $O_2$ sensor responsive means further includes a second fuel passage having upstream and downstream ends connected to said first fuel passage and extending in bypassing relationship to said valve means and a second fixed restriction disposed in said second fuel passage.

3. An air-fuel ratio controlling system according to claim 2, wherein said valve means comprises a solenoid valve having a fully-opened and fully-closed positions, and wherein said $O_2$ sensor responsive means further includes a third fixed restriction disposed in said first fuel circuit in parallel relationship to said second fixed restriction.

* * * * *